US010292463B1

(12) United States Patent
Cipolla

(10) Patent No.: US 10,292,463 B1
(45) Date of Patent: May 21, 2019

(54) FORMABLE DECORATIVE ITEM

(71) Applicant: Steven A. Cipolla, Warwick, RI (US)

(72) Inventor: Steven A. Cipolla, Warwick, RI (US)

(73) Assignee: National Chain Company, Warwick, RI (US)

( * ) Notice: Subject to any disclaimer, the term of this patent is extended or adjusted under 35 U.S.C. 154(b) by 324 days.

(21) Appl. No.: 15/176,236

(22) Filed: Jun. 8, 2016

(51) Int. Cl.
*A44C 5/00* (2006.01)
*A44C 5/14* (2006.01)
*A44C 9/00* (2006.01)
*A44C 15/00* (2006.01)

(52) U.S. Cl.
CPC ..... *A44C 5/0053* (2013.01); *A44C 9/00* (2013.01); *A44C 15/005* (2013.01)

(58) Field of Classification Search
CPC ..... A44C 5/00; A44C 5/0053; A44C 5/0061; A44C 5/0069; A44C 5/0076; A44C 5/12; A44C 15/00; A44C 15/0045; A45D 2/18
USPC ..... 132/246
See application file for complete search history.

(56) References Cited

U.S. PATENT DOCUMENTS 839,538 A 12/1906 Becker
4,540,006 A * 9/1985 Collis ..... A45D 2/18 132/246
5,740,623 A 4/1998 Juhan et al.
5,857,217 A 1/1999 Hsueh
7,011,879 B1 * 3/2006 Contreras ..... B65D 33/30 24/30.5 T
8,506,158 B2 8/2013 Keung et al.
8,776,322 B2 * 7/2014 Martinson ..... B65D 63/10 24/16 PB
2008/0124544 A1 * 5/2008 Alexander ..... H01B 3/12 428/364
2013/0064049 A1 3/2013 Pileri et al.
2016/0355309 A1 * 12/2016 Clark ..... B21F 45/16

FOREIGN PATENT DOCUMENTS

EP 2 712 513 2/2014

* cited by examiner

*Primary Examiner* — Jack W Lavinder
(74) *Attorney, Agent, or Firm* — Salter & Michaelson

(57) ABSTRACT

A formable decorative item that includes an outer sleeve having an outer decorative surface and an inner cavity, an elongated flexible plastic insert that is disposed within the inner cavity of the outer sleeve, and an elongated resilient wire element mounted with the elongated flexible plastic insert and that extends substantially a length of the elongated flexible plastic insert. The elongated resilient wire element is constructed and arranged so that the elongated resilient wire element can be formed in a predetermined configuration and maintained in that predetermined position so as to correspondingly maintain the outer sleeve in the predetermined position.

25 Claims, 9 Drawing Sheets

FORMABLE DECORATIVE ITEM

FIELD OF THE INVENTION

The present invention relates in general to a formable decorative item and more particularly to such an item that can be arranged in the form of a bracelet, necklace or other item. Even more particularly, the present invention relates to a formable decorative item that does not require any closure member in order to secure the item in place, such as about the wrist of a wearer.

BACKGROUND OF THE INVENTION

There are a variety of different bracelets and necklaces that are commonly used. Each of these decorative items require the use of a clasp or the like in order to secure the bracelet or necklace in place. For example, it is common to have some type of a securing clasp associated with a bracelet in order to keep the bracelet on the wrist.

Accordingly, it is an object of the present invention to provide a formable decorative item that can be formed in any one of a number of different configurations including, but not limited to, a bracelet, a necklace or a ring member. In accordance with the present invention the item includes a resilient part that enables the item to be formed into a closed position such as for being disposed about the wrist or neck of a wearer.

Another object of the present invention is to provide a formable decorative item that, once formed into a closed position, is maintained in that position.

Still another object of the present invention is to provide a formable decorative item that does not require any securing clasp or the like in order maintain the closed position.

Still a further object of the present invention is to provide a formable decorative item as stated and that can be constructed simply and is inexpensive to manufacture.

Another object of the present invention is to provide a formable decorative item in which the item can take on a myriad of decorative forms or surfaces.

SUMMARY OF THE INVENTION

To accomplish the foregoing and other objects, features and advantages of the present invention there is provided a formable decorative item that is comprised of an outer sleeve having an outer decorative surface and an inner cavity, said outer sleeve capable of being arranged as any one of a bracelet, necklace or ring member, an elongated flexible plastic insert that is disposed within the inner cavity of the outer sleeve, and an elongated resilient wire element mounted with the elongated flexible plastic insert and that extends substantially a length of the elongated flexible plastic insert. The elongated resilient wire element is constructed and arranged so that the elongated resilient wire element can assume any one of a number of different positions so as to, in turn, position the elongated flexible plastic insert and outer sleeve in any one of the number of different positions.

In accordance with other aspects of the present invention the elongated resilient wire element is constructed and arranged so that the outer sleeve is formable into a first configuration, but re-positionable to a second different position; each of the first and second configurations are a fixed position; the elongated resilient wire element is constructed and arranged so that the outer sleeve is resiliently formable from a more straight configuration to a more curved configuration; the outer sleeve is elongated forming an elongated inner cavity having a longitudinal length; the elongated flexible plastic insert has a length that is comparable to the longitudinal length of the inner cavity of the outer sleeve; including a pair of end caps, one at each end of the outer sleeve for retaining the elongated flexible plastic insert in a stationary location relative to the outer sleeve; the elongated resilient wire element is imbedded in the elongated flexible plastic insert; the elongated resilient wire element is centrally disposed in the elongated flexible plastic insert; including a pair of elongated flexible plastic inserts that are disposed within the inner cavity of the outer sleeve, and a pair of elongated resilient wire element; the pair of elongated flexible plastic inserts re disposed in longitudinal alignment; including an end cap at each end of the outer sleeve, each end cap for retaining the position of one of the pair of elongated flexible plastic inserts; including a plurality of elongated resilient wire elements that each extend a length of the elongated flexible plastic insert; and wherein the plurality of elongated resilient wire element are arranged in a spaced apart parallel configuration.

In accordance with another version of the present invention there is provided a formable decorative item that is comprised of an outer sleeve having an outer decorative surface and an inner cavity, an elongated flexible plastic insert that is disposed within the inner cavity of the outer sleeve, an elongated resilient wire element mounted with the elongated flexible plastic insert and that extends substantially a length of the elongated flexible plastic insert. The elongated resilient wire element is constructed and arranged so that the elongated resilient wire element can be formed in a predetermined configuration and maintained in that predetermined position so as to correspondingly maintain the outer sleeve in the predetermined position.

In accordance with other aspects of the present invention the elongated resilient wire element can assume any one of a number of different positions so as to, in turn, position the elongated flexible plastic insert and outer sleeve in any one of the number of different positions; the elongated resilient wire element is constructed and arranged so that the outer sleeve is resiliently formable from a more straight configuration to a more curved configuration; the outer sleeve is elongated forming an elongated inner cavity having a longitudinal length; the elongated flexible plastic insert has a length that is comparable to the longitudinal length of the inner cavity of the outer sleeve; including a pair of end caps, one at each end of the outer sleeve for retaining the elongated flexible plastic insert in a substantially stationary location relative to the outer sleeve; wherein the elongated resilient wire element is imbedded in the elongated flexible plastic insert; and wherein the elongated resilient wire element is centrally disposed in the elongated flexible plastic insert.

BRIEF DESCRIPTION OF THE DRAWINGS

It should be understood that the drawings are provided for the purpose of illustration only and are not intended to define the limits of the disclosure. In the drawings depicting the present invention, all dimensions are to scale. The foregoing and other objects and advantages of the embodiments described herein will become apparent with reference to the following detailed description when taken in conjunction with the accompanying drawings in which.

DETAILED DESCRIPTION

Figure 1:
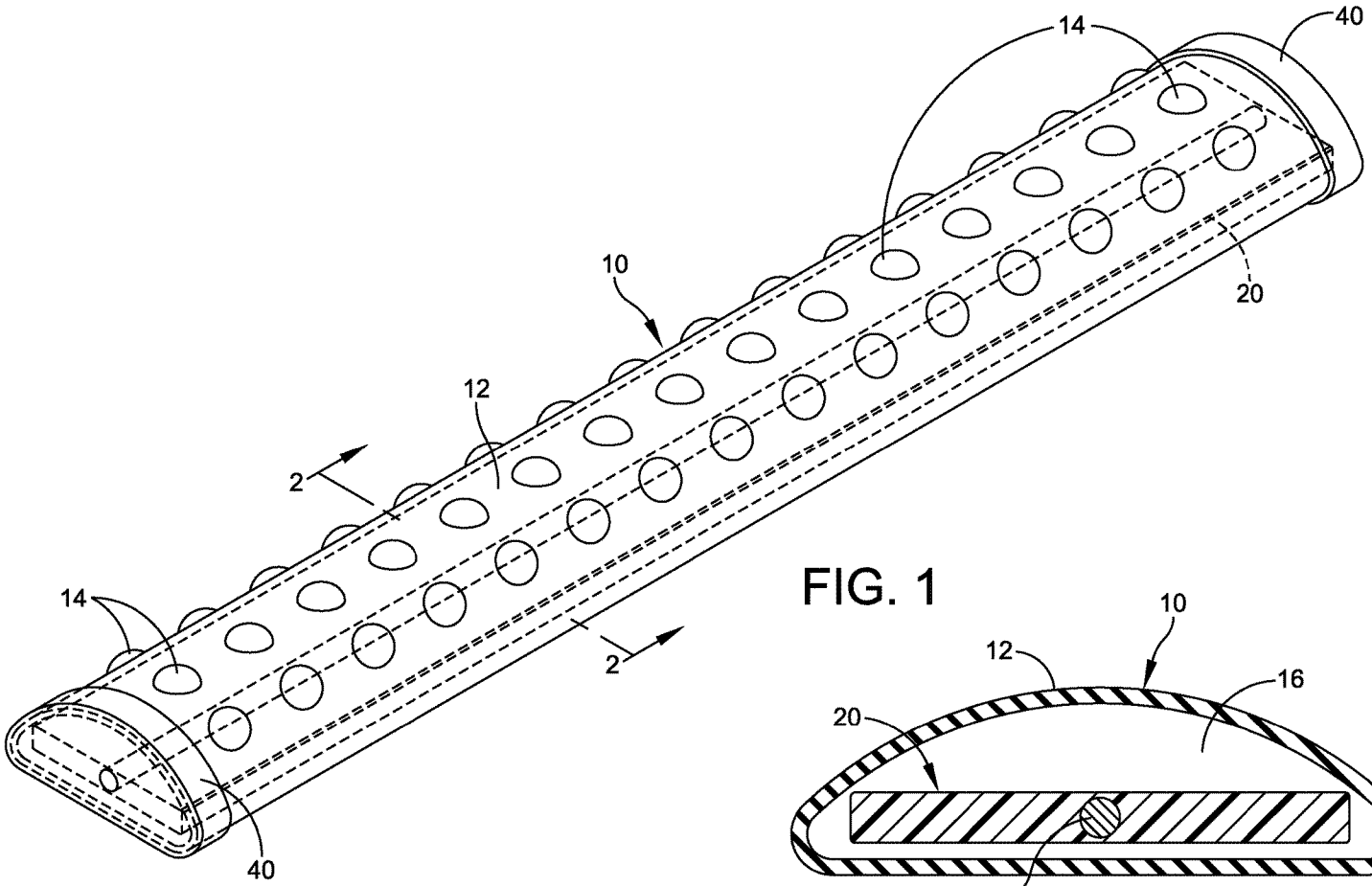
FIG. 1 is a perspective view of one example of an embodiment of the decorative item of the present intention.
Figure 2:
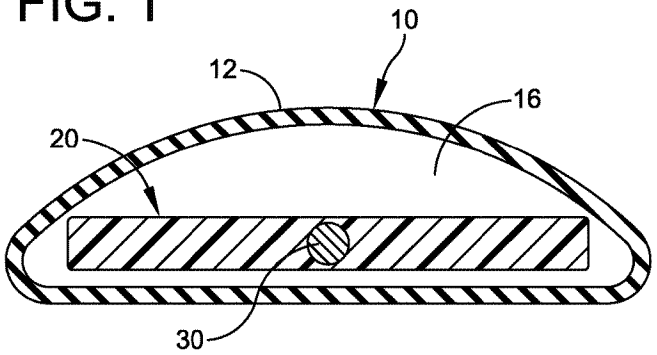
FIG. 2 is a cross-sectional view taken along line 2-2 of FIG. 1.
Figure 6:
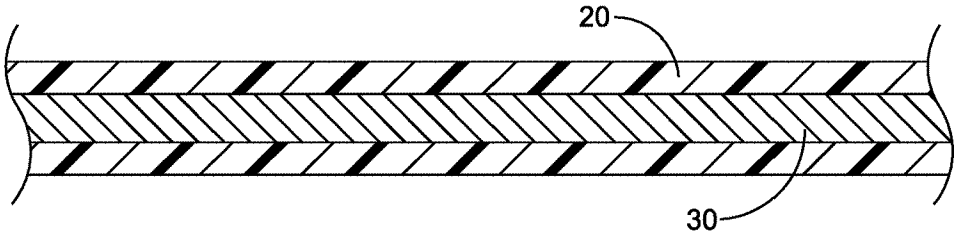
FIG. 6 is an enlarged cross-section taken of FIG. 5.
Figure 7:
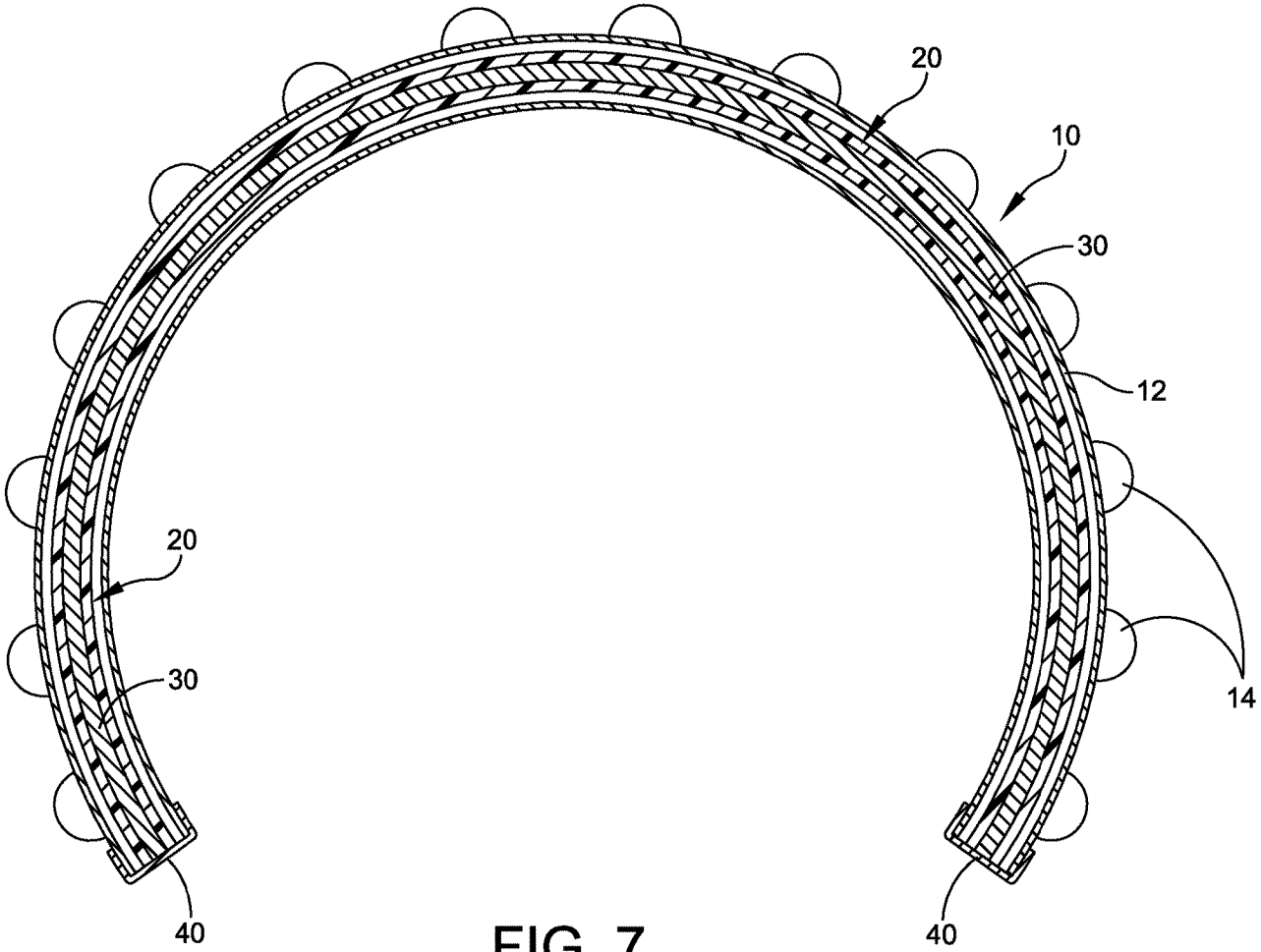
FIG. 7 is a cross-sectional view illustrating the formable decorative item as being formed into a loop such as for placement around the wrist or neck of the wearer.
Figure 8:
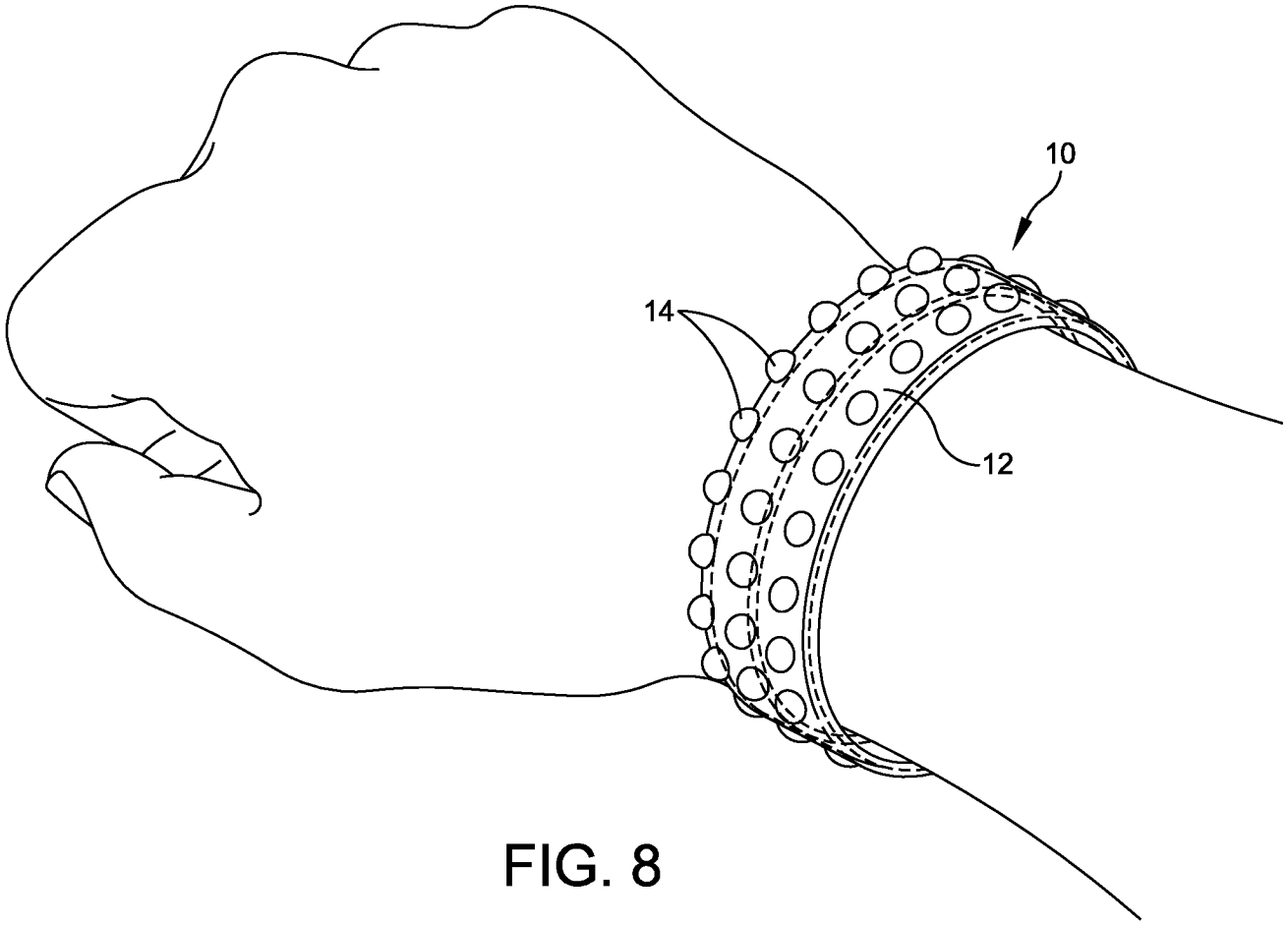
FIG. 8 is a schematic diagram illustrating the formable decorative item as disposed about the wrist of a wearer.

Reference is now made to drawings describing different embodiments of the present invention in FIGS. 1-12. The concept of the present invention relates to a formable decorative item that can be arranged in a number of different configurations and would typically be used as a bracelet or necklace. FIG. 8 of the present application shows the formable decorative item as used as a bracelet by a wearer. The main component of the decorative item is an outer sleeve 10 having an outer decorative surface 12 and defining an inner cavity 16. FIG. 1 describes an outer sleeve 10 and have also illustrated decorative pieces 14 that are disposed on an outer surface 12 of the outer sleeve. These decorative pieces 14 are only one of many examples of a decorative feature that can be used. Although the sleeve 10 is described as being closed, in another version in accordance with the present invention the sleeve may take on other forms and even be partially open. The important point is that the sleeve will have some type of a cavity 16 into which is inserted an elongated resilient member. By "resilient" it means that the member is able to return to an original shape or configuration after being bent, stretched, pressed or pulled. For example, FIG. 1 may be considered as a first position wherein the formable decorative item extends substantially straight while FIG. 7 may be considered as a second position where the decorative item is formed in a loop, and can be maintained in that loop after being forceable moved to the loop configuration. Each different position can be moved to and maintained in that position without requiring any securing clasp or the like.

The elongated resilient member is described herein as comprised of an elongated flexible plastic insert 20. This may be constructed of a number of different materials including, but not limited to, a shrink-wrap plastic material. As illustrated in, for example, the cross-sectional view of FIG. 2, this elongated flexible plastic insert is disposed within the inner cavity 16 of the outer sleeve 10. The other component to the resilient member is an elongated resilient wire element 30 that is mounted with the elongated flexible plastic insert and that extends substantially the same length as the length of the elongated flexible plastic insert. The material of the elongated flexible plastic insert 20 is pliable and thus is able to bend. The elongated resilient wire element 30 is the main resilient member and main control of the bending action.

Figure 3:
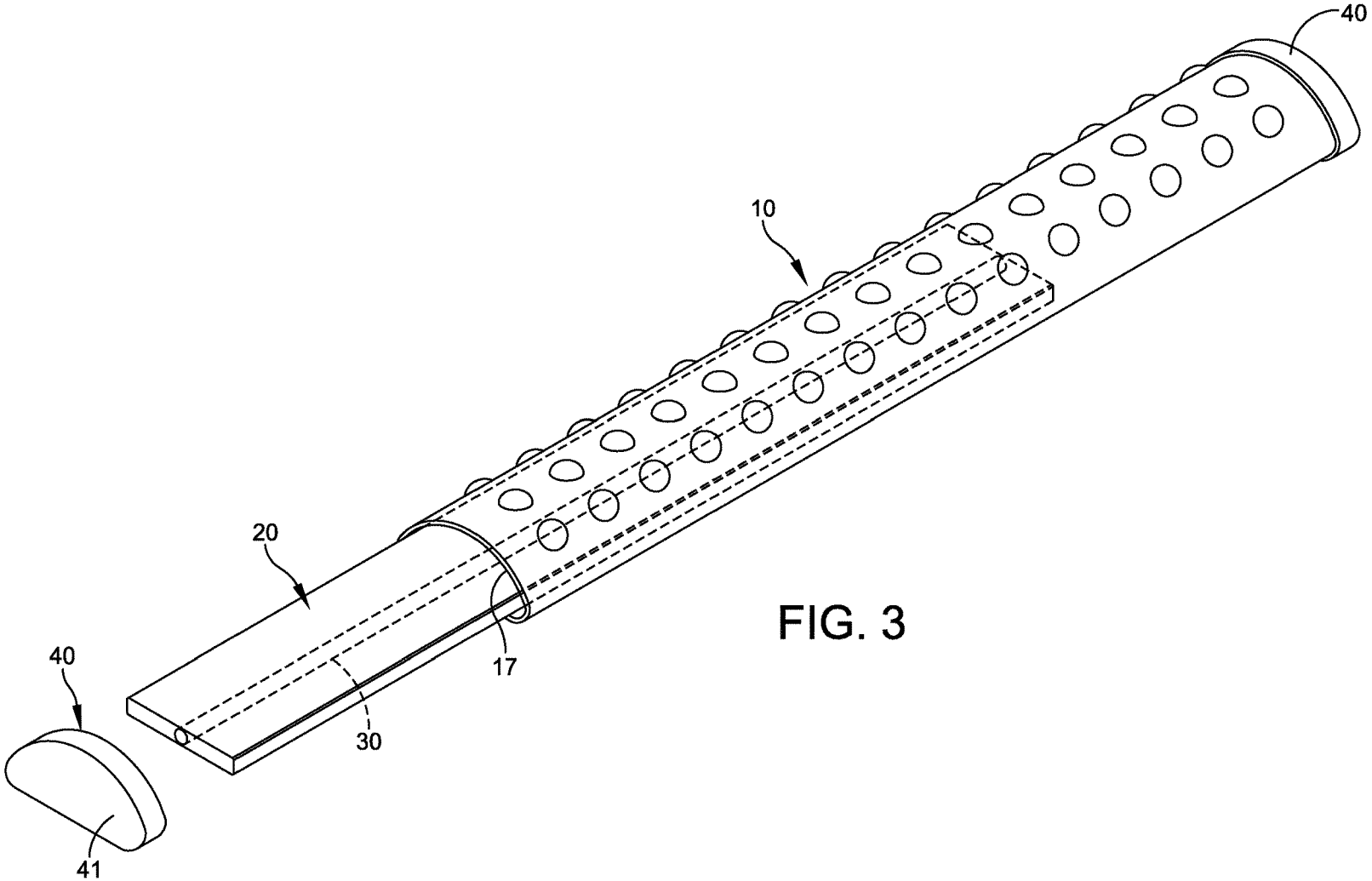
FIG. 3 is a perspective view similar to that illustrated in FIG. 1 with some of the components exploded away.
Figure 4:
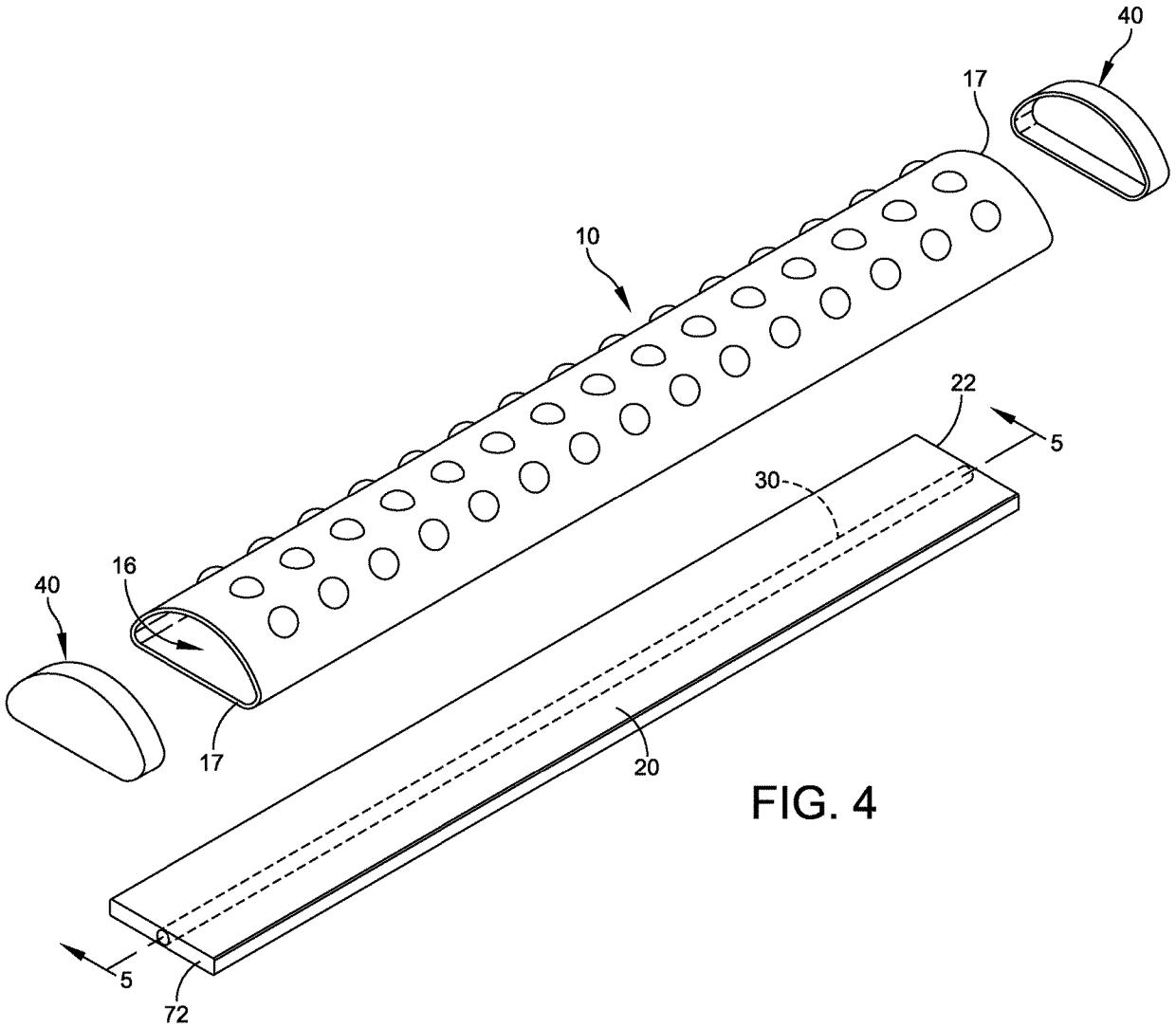
FIG. 4 is an exploded perspective view showing the main components of the formable decorative item of the present invention.

Reference may also be made to FIGS. 3 and 4 showing the elongated flexible plastic insert 20 with the resilient wire element 30 extending substantially the same length as between the ends of the elongated flexible plastic insert. Also, the insert 20 preferably has its ends 22 disposed at approximately the same position as the ends 17 of the outer sleeve 10.

The elongated resilient wire element is constructed and arranged so that it can assume any one of a number of different positions or configurations. This is accomplished by simply bending the entire formable decorative item such as into the loop illustrated in FIG. 7. In particular, the elongated resilient wire element will maintain that loop configuration. This is also illustrated in FIG. 8. This looped position can be considered as a stationary or fixed position. In this manner, by forming the entire decorative item about the wrist, as illustrated in FIG. 8, one need not employ any clasps between the ends of the formed loop.

Another part of the formable decorative item is the inclusion of end caps 40. These end caps 40 are disposed about the end edges 17 of the outer sleeve 10. Once the formable decorative item is constructed, the end caps 40 can be set in place and can be secured by an adhesive or some other means with the outer sleeve 10. The pair of end caps essentially retains the elongated plastic insert and the resilient wire element in a substantially fixed position within and relative to the outer sleeve 10. Thus, the outer wall 41 of each end cap 40 is disposed closely adjacent to an end 22 of the elongated flexible plastic insert 20.

Figure 5:
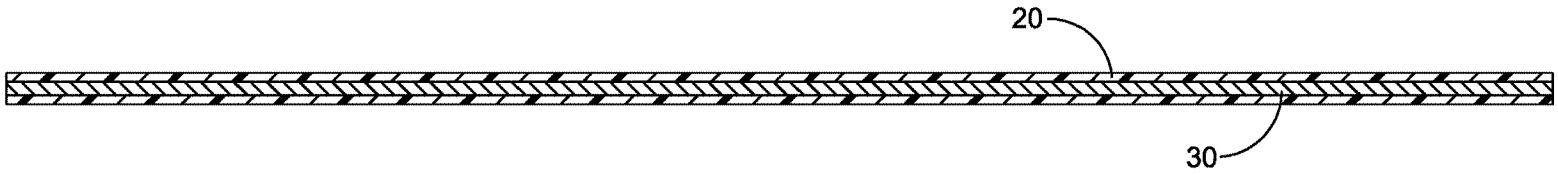
FIG. 5 is a cross-sectional view taken along line 5-5 of FIG. 4.

Reference is now made to the cross-sectional views of FIGS. 5 and 6. FIG. 5 is a cross-sectional view taken along line 5-5 of FIG. 4. These views illustrate the elongated resilient wire element 30 as essentially embedded in the elongated flexible plastic insert 20. This wire element may be embedded or may be mounted in another way with the elongated flexible plastic insert.

As indicated previously, FIGS. 7 and 8 show the wearer forming a straight member such as illustrated in FIG. 1 into a loop for being secured about the wrist or neck of a wearer. In FIG. 7 the ends where the end caps 40 are disposed are shown spaced apart. However, these ends could also be formed in another manner so that they pass each other. This would depend upon the overall length of the formable decorative item in comparison to the location that it is being used on the wearer.

Figure 9:
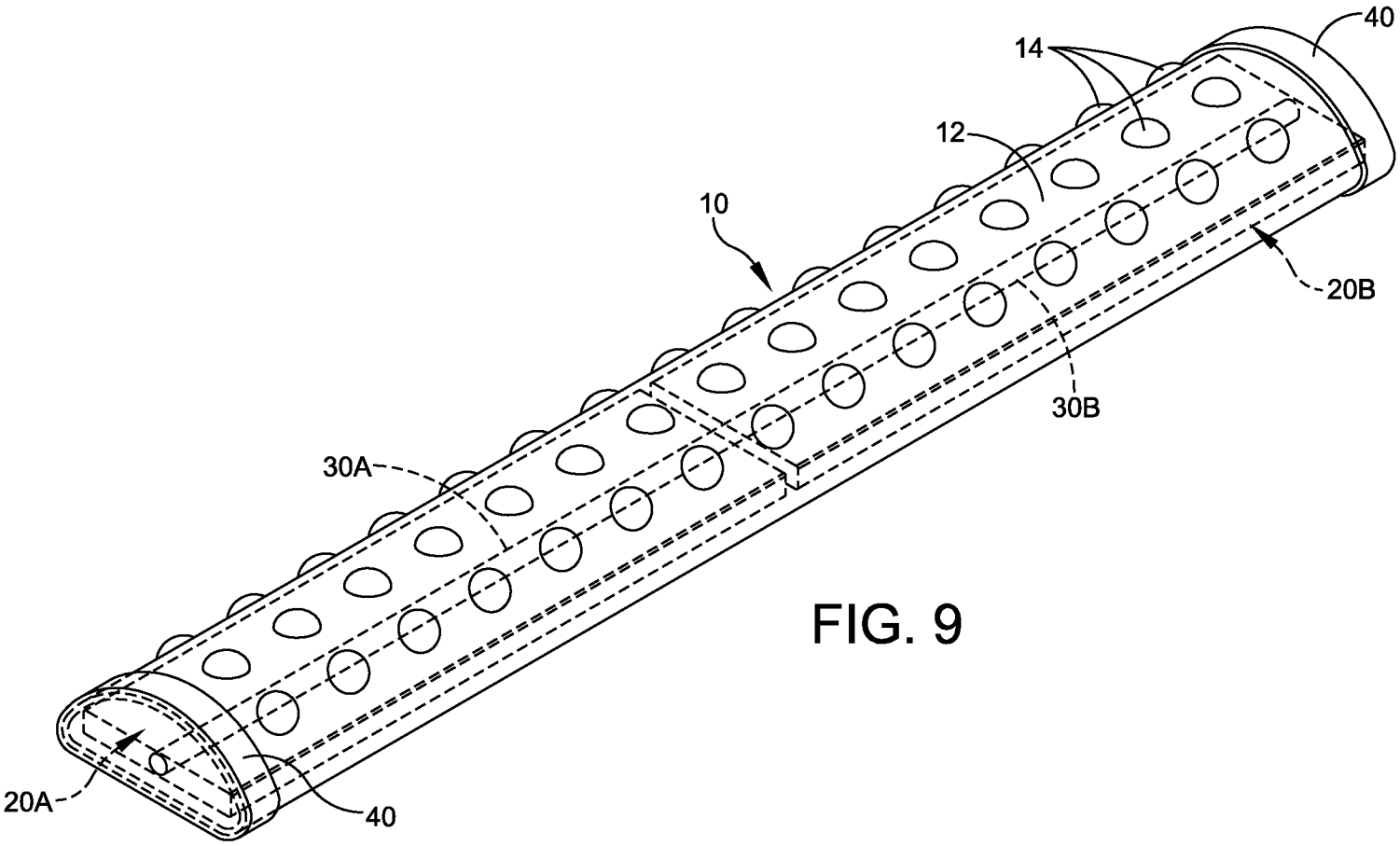
FIG. 9 is a perspective view of an alternate embodiment of the present invention employing a pair of inserts.
Figure 10:
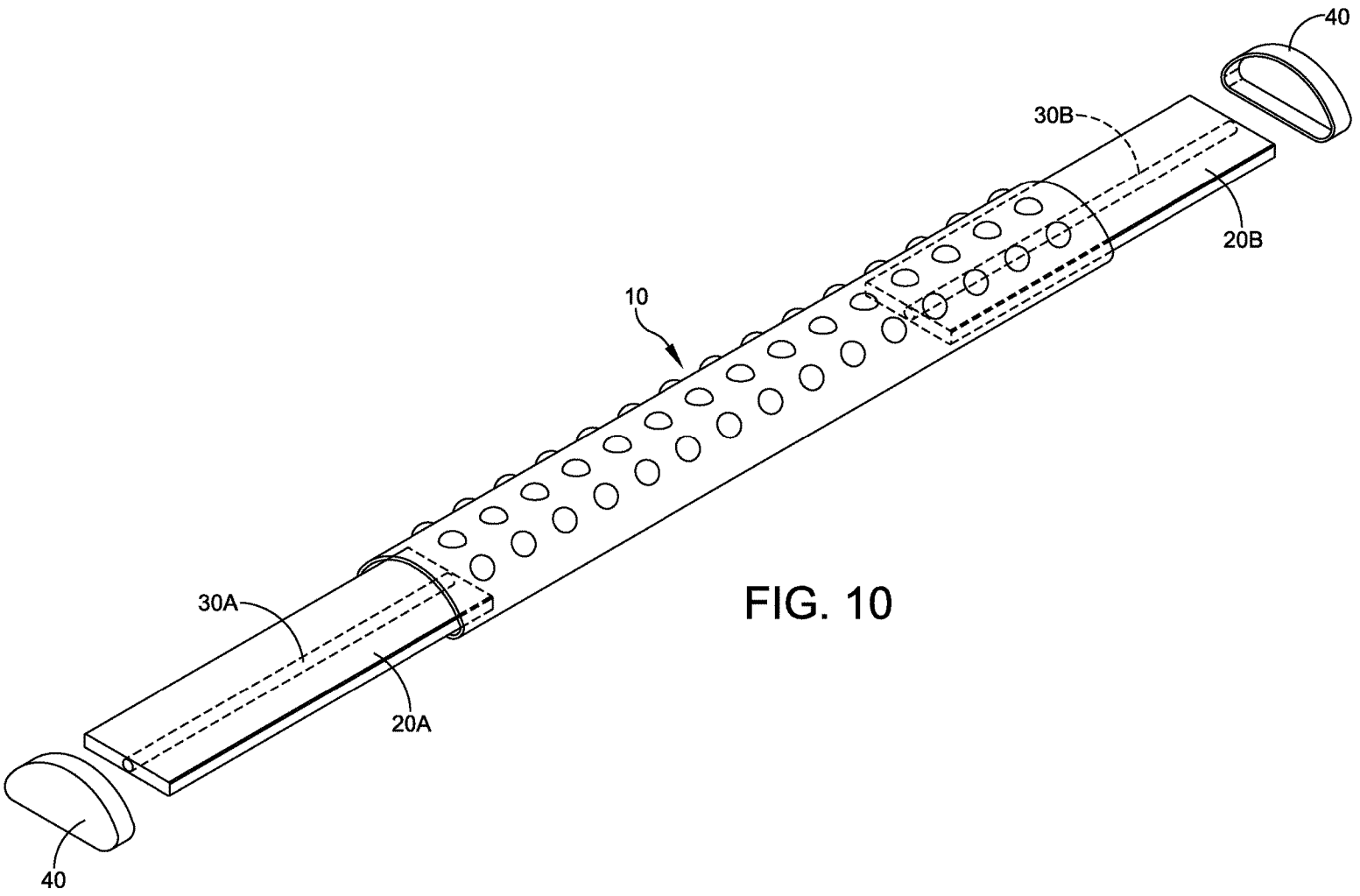
FIG. 10 is a perspective view like that shown in FIG. 9 but with some of the components exploded away.

Reference is now made to FIGS. 9 and 10 for an alternate embodiment of the present invention. This embodiment also uses an outer sleeve 10. However, instead of a single elongated flexible plastic insert, there is illustrated a pair of inserts at 20A and 20B. These inserts may butt against each other from the inside of the sleeve and ends thereof extend to the end wall 41 of the end caps. In this embodiment each of the elongated flexible plastic inserts 20A, 20B is also provided with a respective elongated resilient wire element 30A, 30B.

Figure 11:
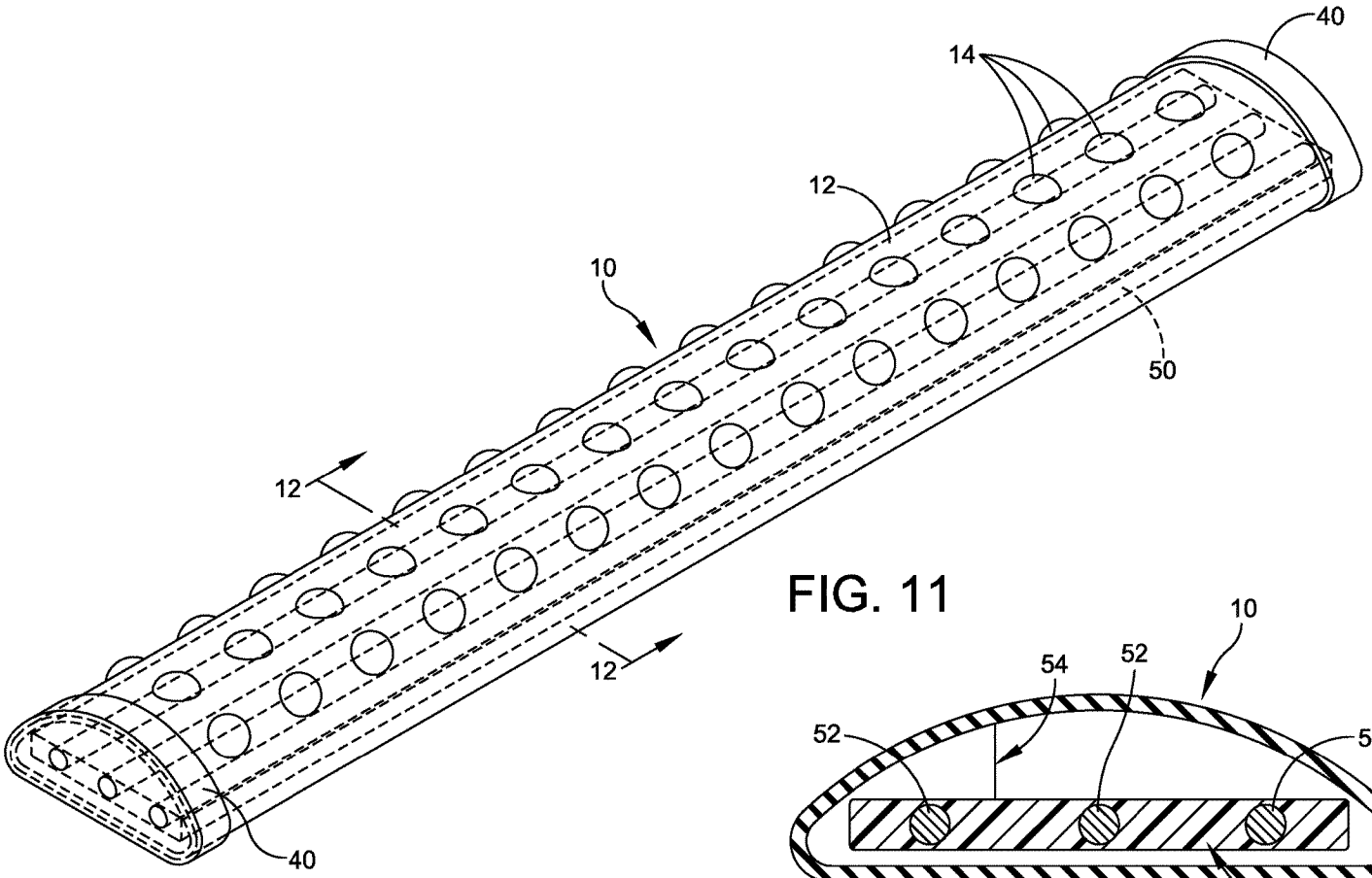
FIG. 11 is a perspective view of still another embodiment of the present invention employing more than one elongated resilient wire element.
Figure 12:
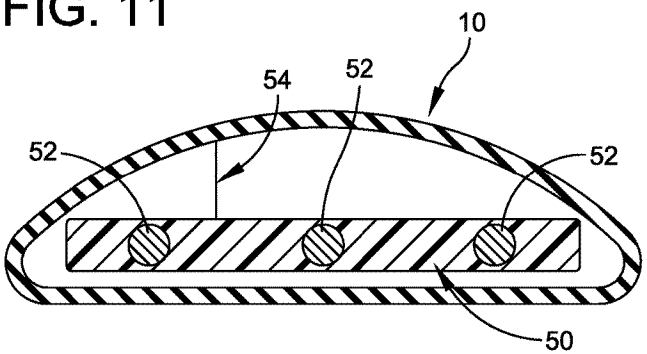
FIG. 12 is a cross-sectional view taken along line 12-12 of FIG. 11.

Reference is also made to still another embodiment of the present invention illustrated in FIGS. 11 and 12. This embodiment also includes an outer sleeve 10 and a single elongated flexible plastic insert that is identified in FIG. 12 as the insert 50. In this embodiment of the invention rather than having a single elongated resilient wire element, a plurality of elements 52 are illustrated. These elements 52 are separated from each other in that particular embodiment in a parallel and spaced apart manner.

Having now described a limited number of embodiments of the present invention, it should now be apparent to those skilled in the art that numerous other embodiments and modifications thereof are contemplated as falling within the scope of the present invention, as defined by the appended claims. For example, herein we have described an outer sleeve 10 and have also illustrated decorative pieces 14 that are disposed on an outer surface 12 of the outer sleeve. These decorative pieces are only shown as one of many different examples of the form that the outer sleeve 10 can take. The sleeve 10 can even have a decorative effect on the surface 12. In accordance with the present invention, it is anticipated that there are a myriad of constructions of the sleeve 10 that can assume many different configurations and many different types and styles. Of importance is the fact that an elongated resilient member is inserted in the cavity of the sleeve that enables the overall formable decorative item to be formed into many different configurations and maintained in those configurations. The item is maintained primarily by the use of an elongated resilient wire element that can be bent into various configurations for use by the wearer. In each of these configurations primarily the elongated wire element maintains the desired position. Yet, the wearer can also remove the formable decorative item quite easily by reversing the action so as to open the formable decorative item to remove it. The formable decorative item may be in a straight position such as shown in FIG. 1 and from that position can be formed into a number of different configurations.

The invention claimed is:

1. A formable decorative item that is for securing about a body part of a wearer and that is comprised of an outer sleeve having an outer decorative surface and an inner cavity, said outer sleeve capable of being arranged as any one of a bracelet, necklace or ring member, an elongated flexible plastic insert that is disposed within the inner cavity of the outer sleeve while leaving a hollow space about the elongated flexible plastic insert and between the elongated flexible plastic insert and an inner surface of the outer sleeve, an elongated resilient wire element mounted with the elongated flexible plastic insert and that extends substantially a length of the elongated flexible plastic insert, said elongated resilient wire element comprised of a straight uniform diameter wire, said elongated resilient wire element being constructed and arranged so that the elongated resilient wire element assumes any one of a number of different positions so as to, in turn, position the elongated flexible plastic insert and outer sleeve in any one of the number of different positions, said different positions including a respective first configuration, and a respective second configuration that is more curved than the first configuration so as to secure the formable decorative item about the body part of the wearer; and wherein the elongated resilient wire element is comprised of a plurality of elongated resilient wire elements that each extend a length of the elongated flexible plastic insert.

2. The formable decorative item of claim 1 wherein the hollow space that is about the elongated flexible plastic insert extends substantially the entire length of the elongated flexible plastic insert.

3. The formable decorative item of claim 2 wherein each of the first and second configurations are a fixed position, and the hollow space is continuous both about and along the elongated flexible plastic insert.

4. The formable decorative item of claim 1 wherein the elongated resilient wire element is constructed and arranged so that the outer sleeve is resiliently formable from a more straight configuration to a more curved configuration.

5. The formable decorative item of claim 1 wherein said outer sleeve is elongated forming an elongated inner cavity having a longitudinal length.

6. The formable decorative item of claim 5 wherein said elongated flexible plastic insert has a length that is comparable to the longitudinal length of the inner cavity of the outer sleeve.

7. The formable decorative item of claim 6 including a pair of end caps, one at each end of the outer sleeve for retaining the elongated flexible plastic insert in a stationary location relative to the outer sleeve.

8. The formable decorative item of claim 1 wherein the elongated resilient wire element is imbedded in the elongated flexible plastic insert.

9. The formable decorative item of claim 8 wherein the elongated resilient wire element is centrally disposed in the elongated flexible plastic insert.

10. The formable decorative item of claim 1 wherein the plurality of elongated resilient wire element are arranged in a spaced apart parallel configuration.

11. A formable decorative item that is comprised of an outer sleeve having an outer decorative surface and an inner cavity, said outer sleeve capable of being arranged as any one of a bracelet, necklace or ring member, an elongated flexible plastic insert that is disposed within the inner cavity of the outer sleeve, an elongated resilient wire element mounted with the elongated flexible plastic insert and that extends substantially a length of the elongated flexible plastic insert, said elongated resilient wire element being constructed and arranged so that the elongated resilient wire element can assume any one of a number of different positions so as to, in turn, position the elongated flexible plastic insert and outer sleeve in any one of the number of different positions, and including a pair of elongated flexible plastic inserts that are disposed within the inner cavity of the outer sleeve, and a pair of elongated resilient wire elements.

12. The formable decorative item of claim 11 wherein the pair of elongated flexible plastic inserts are disposed in longitudinal alignment.

13. The formable decorative item of claim 12 including an end cap at each end of the outer sleeve, each end cap for retaining the position of one of the pair of elongated flexible plastic inserts.

14. A formable decorative item that is for securing about a body part of a wearer and that is comprised of an outer sleeve having an outer decorative surface and an inner cavity, an elongated flexible plastic insert that is disposed within the inner cavity of the outer sleeve while leaving a hollow space about the elongated flexible plastic insert and between the elongated flexible plastic insert and an inner surface of the outer sleeve, an elongated resilient wire element mounted with the elongated flexible plastic insert and that extends substantially a length of the elongated flexible plastic insert, said elongated resilient wire element being constructed and arranged so that the elongated resilient wire element is formed in a predetermined configuration and maintained in that predetermined configuration so as to correspondingly maintain the outer sleeve in the predetermined configuration, the outer sleeve having a first configuration, and thereafter arranging the outer sleeve in a second configuration that is more curved than the first configuration so as to secure the formable decorative item about the body part of the wearer, wherein the elongated flexible plastic insert has respective top and bottom surfaces, the outer sleeve has respective top and bottom segments, the bottom segment of the outer sleeve is substantially planar and the top segment of the outer sleeve is arcuate in shape.

15. A formable decorative item of claim 14 wherein the elongated resilient wire element can assume any one of a number of different positions so as to, in turn, position the elongated flexible plastic insert and outer sleeve in any one of the number of different positions.

16. The formable decorative item of claim 14 wherein the elongated resilient wire element is constructed and arranged so that the outer sleeve is resiliently formable from a more straight configuration to a more curved configuration.

17. The formable decorative item of claim 14 wherein said outer sleeve is elongated forming an elongated inner cavity having a longitudinal length.

18. The formable decorative item of claim 17 wherein said elongated flexible plastic insert has a length that is comparable to the longitudinal length of the inner cavity of the outer sleeve.

19. The formable decorative item of claim 18 including a pair of end caps, one at each end of the outer sleeve for retaining the elongated flexible plastic insert in a substantially stationary location relative to the outer sleeve.

20. The formable decorative item of claim 14 wherein the elongated resilient wire element is imbedded in the elongated flexible plastic insert.

21. The formable decorative item of claim 20 wherein the elongated resilient wire element is centrally disposed in the elongated flexible plastic insert.

22. A formable decorative item of claim 14 wherein the hollow space includes an upper hollow space that is disposed between the top surface of the elongated flexible plastic insert and the top segment of the outer sleeve, and a lower hollow space that is disposed between the bottom surface of the elongated flexible plastic insert and the bottom segment of the outer sleeve.

23. The formable decorative item of claim 22 wherein the upper hollow space is larger in area than the lower hollow space.

24. The formable decorative item of claim 22 wherein the upper hollow space has a height that is greater than a height of the lower hollow space.

25. The formable decorative item of claim 22 wherein the bottom segment of the outer sleeve has a planar cross-section and is of uniform thickness; wherein the top segment of the outer sleeve has a concave arcuate cross-section and is of uniform thickness; and wherein the top and bottom segments of the outer sleeve are contiguous.

* * * * *